US005347716A

United States Patent [19]

Crook

[11] Patent Number: 5,347,716

[45] Date of Patent: Sep. 20, 1994

[54] SAFETY RAZORS

[75] Inventor: Alan Crook, Pamber Heath Basingstoke, United Kingdom

[73] Assignee: The Gillette Company, Boston, Mass.

[21] Appl. No.: 30,078

[22] Filed: May 27, 1993

[30] Foreign Application Priority Data

Oct. 11, 1990 [GB] United Kingdom ..... 9022128

[51] Int. Cl.[5] ..... B26B 21/14

[52] U.S. Cl. ..... 30/77; 30/34.2

[58] Field of Search ..... 30/34.05, 34.2, 47–50, 30/77

[56] References Cited

U.S. PATENT DOCUMENTS

| | | | |
|---|---|---|---|
| 3,673,684 | 7/1972 | Muntz | 30/34.2 |
| 3,939,560 | 2/1976 | Lyall | 30/34.2 |
| 4,189,832 | 2/1980 | Harper | 30/34.2 |
| 4,741,103 | 5/1988 | Hultman | 30/34.2 |
| 4,998,347 | 3/1991 | Schachter | 30/34.2 |

*Primary Examiner*—Douglas D. Watts

[57] ABSTRACT

A safety razor in which at least part of the skin engaging surface thereof has an adherent coating comprising substantially spherical elastomeric particles in a polymer matrix, the size and concentration of such particles being such that the coated surface has a surface roughness with spaced major and subsidiary peaks.

4 Claims, 2 Drawing Sheets

SAFETY RAZORS

This invention relates to razors having one or more blades and skin engaging surfaces arranged ahead of and/or behind the blade edge or edges.

The invention is applicable to razors of various forms, such as so-called 3-piece razors, one-piece, or disposable razors and to razors in which the blade or blades are present in a replaceable blade cartridge.

In conventional razors, the skin engaging surfaces are formed as cap and guard members, the cap member being positioned behind the blade edge(s) and the guard member ahead of the edge(s).

A number of proposals have been made for providing the cap and/or guard surfaces with surface configurations or textures. Thus, for example, British Specification 1,458,356, describes a safety razor having a guard surface, at least part of which has a roughness of between 0.5 and 10.0 micrometers ($\mu$m) centre-line-average values. The spacing of the peaks is preferably from 0.5 to 5.0 times the surface roughness.

The surface roughness may, for example, be obtained by abrading the surface with particles of grit, ceramics, oxides or metals, by mechanical roughening, or by roughening the surface of a mould in which the guard surface is formed. Alternatively the guard surface may be coated or impregnated with particles, for example particles of grit, ceramics, oxides or metals, to give the desired surface roughness.

It is known that small discrete regions of the skin, approximately 1 mm across on the face, are served by separate nerve networks so that it is not possible subjectively to distinguish between two separate points of pressure applied to skin less than about 1 mm apart. These areas can be stimulated repeatedly by a succession of pressure points moving across them. By controlling the pressure to a low but adequate level it can be assured that the sensation is pleasant, but it has been found, surprisingly, that this raises the threshold stimulus level for discomfort. That is to say, the pleasant tactile sensation due to the provision of an appropriate texture on a skin engaging surface of the razor tends to mask the sensations caused by contact of the blade edge(s) with the skin and, more significantly, the facial hairs as they are severed.

We have now found that a particularly favourable effect can be obtained by providing at least part of the skin engaging surface of a safety razor with an adherent coating comprising substantially spherical elastomeric particles in a polymer matrix, the size and concentration of such particles being such that the coated surface has a surface roughness and spacing of the major and subsidiary peaks within certain selected ranges.

According to the present invention, there is provided a safety razor having one or more blades and skin engaging cap and guard surfaces, in which at least part of the skin engaging surface is provided with an adherent coating comprising substantially spherical elastomeric particles in a polymer matrix, the size and concentration of such particles being such that the coated surface has a surface roughness of 4 to 10 $\mu$m center-line-average, with the spacing of the major peaks at 20 to 30 times the surface roughness and the spacing of the subsidiary peaks at 6 to 10 times the surface roughness.

The "centre-line-average" value of the surface roughness is defined in British Standard BS 1134:1961 and corresponds to the term "arithmetical average" used in U.S. Standard ASA B46. The term "spacing" is also used in BS 1134:1961 and refers to the average distance between the peaks (major or subsidiary) referred to.

The coating is preferably provided on the guard surface or the guard and cap surfaces. We have found that best results are obtained when at least 75 mm$^2$ and preferably at least 120 mm$^2$ of skin engaging surface is coated.

For the better understanding of the invention, a preferred embodiment will now be described, by way of example, with reference to the accompanying drawings, in which.

Figure 1:
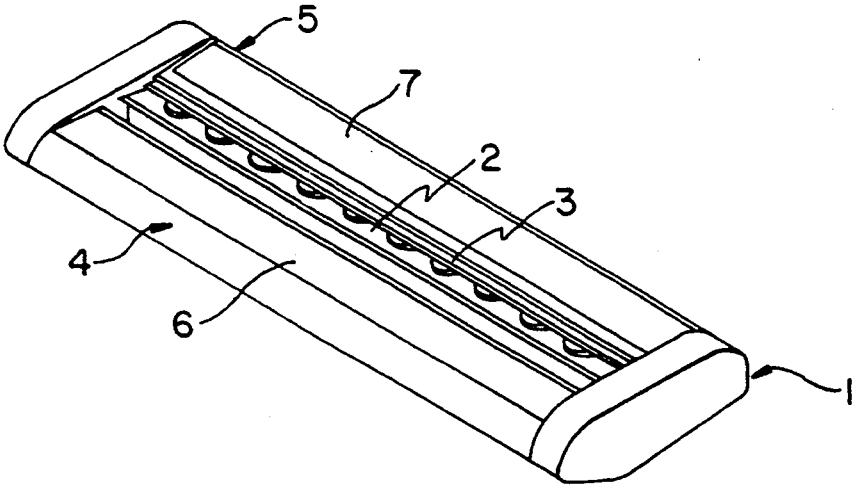
FIG. 1 is a perspective view of a razor cartridge.

A safety razor cartridge of conventional form is shown in FIG. 1. The cartridge body 1 is of moulded construction (usually being made up of a number of individual mouldings) in which are permanently secured a pair of blades 2,3 whose cutting edges are disposed to act in tandem upon the skin. The body is formed to provide a guard member 4 and a cap member 5 having skin engaging surfaces 6 and 7, respectively, to engage the skin ahead of and behind the blade edges.

In accordance with the invention, a part or the whole of one or both of the surfaces 6 and 7 is provided with a coating of the kind described.

In a currently preferred embodiment, the coating is formed by spraying the surface to be coated with a texturising paint comprising substantially spherical elastomeric particles in an elastomeric polyurethane binder, the majority of the particles having a diameter of less than 70 $\mu$m and the particles having a mean size of 30 $\mu$m. Spraying is effected to form a coating which has a dried thickness of 0.04 to 0.1 mm and the coated area should be at least 75 mm$^2$ and preferably at least 120 mm$^2$.

A suitable texturising paint for this purpose is commercially available from Sonneborn & Rieck Limited as "Jaxalac" Two Pack V.T.1. finish. This paint is formulated as a two-pack polyurethane paint using an aliphatic polyisocyanate curing agent.

Figure 2:
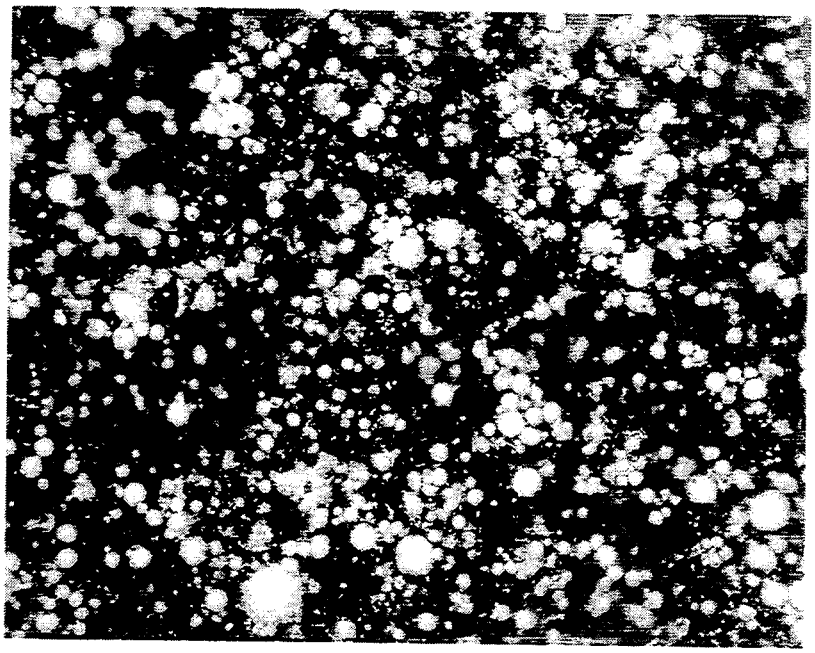
FIG. 2 is an optical micrograph of a coated surface.
Figure 3:
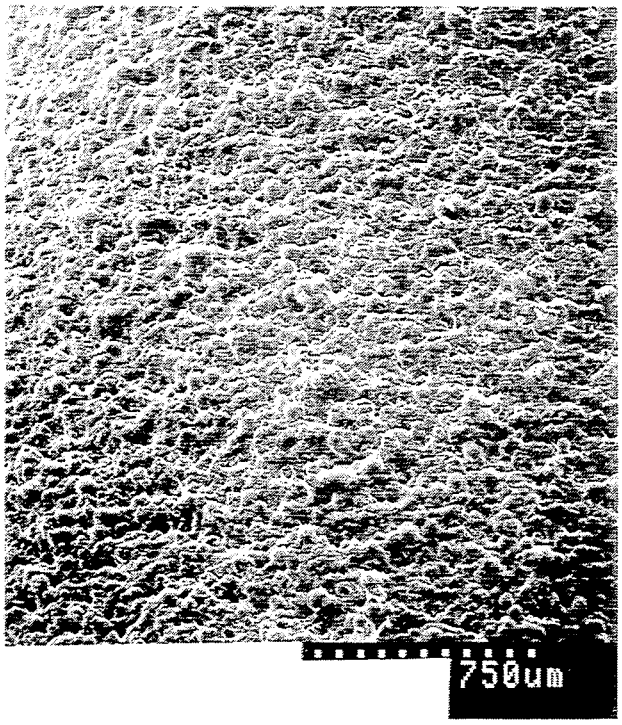
FIG. 3 is a scanning electron micrograph of a coated surface.

Micrographs of coatings obtained with this paint form FIGS. 2 and 3. FIG. 2 is an optical micrograph at a magnification of X25; the spherical nature of the texturising particles can be clearly seen.

FIG. 3 is a scanning electron micrograph at a magnification of $\times$40 (45° tilt); it will be seen that the spherical particles give rise to rounded peaks which may be contrasted to the angular peaks which would be obtained by the use of grit.

I claim:

1. A safety razor having one or more blades and skin engaging cap and guard surfaces, in which at least part of the skin engaging surface is provided with an adherent coating comprising substantially spherical elastomeric particles in a polymer matrix, the size and concentration of such particles being such that the coated surface has a surface roughness of 4 to 10 $\mu$m centre-line-average, with the spacing of the major peaks at 20 to 30 times the surface roughness and the spacing of the subsidiary peaks at 6 to 10 times the surface roughness.

2. A safety razor according to claim 1, in which at least 75 mm$^2$ of skin engaging surface is provided with said coating.

3. A safety razor according to claim 1, in which the coating is present on the guard surface.

4. A safety razor according to claim 1, in which said coating is formed by spraying the skin contacting surface with a texturising paint comprising substantially spherical elastomeric particles in an elastomeric polyurethane binder, the majority of the particles having a diameter less than 70 μm and the particles having a mean size of 30 μm, to form a dried coating having a thickness of 0.04 to 0.1 mm.

* * * * *